US008497886B2

(12) United States Patent
Chang et al.

(10) Patent No.: US 8,497,886 B2
(45) Date of Patent: Jul. 30, 2013

(54) ILLUMINATION APPARATUS AND METHOD OF DRIVING THE SAME

(75) Inventors: Seung-Wook Chang, Yongin (KR); Mu-Hyun Kim, Yongin (KR)

(73) Assignee: Samsung Display Co., Ltd., Yongin (KR)

( * ) Notice: Subject to any disclaimer, the term of this patent is extended or adjusted under 35 U.S.C. 154(b) by 434 days.

(21) Appl. No.: 12/649,607

(22) Filed: Dec. 30, 2009

(65) Prior Publication Data

US 2010/0188436 A1 Jul. 29, 2010

(30) Foreign Application Priority Data

Jan. 29, 2009 (KR) ..... 10-2009-0006978

(51) Int. Cl.
*G09G 5/10* (2006.01)

(52) U.S. Cl.
USPC ..... 345/690; 345/691; 345/692

(58) Field of Classification Search
USPC ..... 345/3.3, 22, 55, 76, 82–102, 204, 345/206, 213, 698, 1.3, 690–692; 348/42–60, 348/453, 750, 757, 760; 313/500–506; 315/169.3, 149, 294, 291; 356/30, 98
See application file for complete search history.

(56) References Cited

U.S. PATENT DOCUMENTS 6,614,415 B2 * 9/2003 Mizutani et al. ..... 345/90
6,677,709 B1 * 1/2004 Ma et al. ..... 313/504
6,809,717 B2 * 10/2004 Asao et al. ..... 345/102
6,836,265 B1 * 12/2004 Lee et al. ..... 345/87
7,420,657 B2 * 9/2008 Sasian et al. ..... 356/30
7,755,569 B2 * 7/2010 Wang et al. ..... 345/3.3
7,762,470 B2 * 7/2010 Finn et al. ..... 235/492
7,782,283 B2 * 8/2010 Hong et al. ..... 345/88
8,004,209 B2 * 8/2011 Sekulovski et al. ..... 315/291
8,207,933 B2 * 6/2012 Shin et al. ..... 345/102

(Continued)

FOREIGN PATENT DOCUMENTS

KR 10-0578842 5/2006
KR 10-2008-0041264 5/2008
KR 10-2008-0061760 7/2008
KR 10-2008-0078634 8/2008

OTHER PUBLICATIONS

Korean Office Action dated Oct. 20, 2010, issued in corresponding Korean Patent Application No. 10-2009-0006978.

(Continued)

*Primary Examiner* — Prabodh M Dharia
(74) *Attorney, Agent, or Firm* — Christie, Parker & Hale, LLP

(57) ABSTRACT

The illumination apparatus includes: a light emitting unit includes scanning lines, data lines crossing the corresponding scanning lines, and light emitting areas connected between the scanning lines and the data lines, where the light emitting areas include a first light emitting area including at least two first organic light emitting devices emitting a first color and a second light emitting area including at least two second light emitting devices emitting a second color different from the first color; and a driving unit non-simultaneously driving the first light emitting area and the second light emitting area to emit light during a frame. The method of driving the illumination apparatus includes individually emitting light from the first and second light emitting areas by respectively applying data signals to the first and second light emitting areas via the data lines connected thereto during a frame.

26 Claims, 3 Drawing Sheets

U.S. PATENT DOCUMENTS

| | | | | |
|---|---|---|---|---|
| 2004/0007970 | A1* | 1/2004 | Ma et al. | 313/504 |
| 2004/0119677 | A1* | 6/2004 | Nakamura et al. | 345/89 |
| 2005/0200834 | A1* | 9/2005 | Sasian et al. | 356/30 |
| 2005/0219476 | A1* | 10/2005 | Beeson et al. | 353/98 |
| 2005/0259095 | A1* | 11/2005 | Kwak | 345/204 |
| 2006/0206582 | A1* | 9/2006 | Finn | 709/217 |
| 2007/0045549 | A1* | 3/2007 | Wang et al. | 250/370.08 |
| 2007/0085794 | A1* | 4/2007 | Kawabe et al. | 345/89 |
| 2007/0182316 | A1* | 8/2007 | Mathai et al. | 313/504 |
| 2008/0024698 | A1* | 1/2008 | Lin | 349/62 |
| 2008/0111834 | A1* | 5/2008 | Mignard | 345/690 |
| 2008/0225397 | A1* | 9/2008 | Thiel et al. | 359/604 |
| 2008/0246703 | A1 | 10/2008 | Smith | |
| 2009/0051710 | A1 | 2/2009 | Weitbruch et al. | |
| 2009/0073109 | A1* | 3/2009 | Shin et al. | 345/102 |
| 2009/0135205 | A1* | 5/2009 | Wu et al. | 345/690 |

OTHER PUBLICATIONS

Korean Office action dated Jul. 28, 2011issued to corresponding application No. KR 10-2009-0006978, listing the cited reference in this IDS, 5 pages.

* cited by examiner

ILLUMINATION APPARATUS AND METHOD OF DRIVING THE SAME

CROSS-REFERENCE TO RELATED APPLICATION

This application claims the benefit of Korean Patent Application No. 10-2009-0006978, filed on Jan. 29, 2009 in the Korean Intellectual Property Office, the disclosure of which is incorporated herein in its entirety by reference.

BACKGROUND OF THE INVENTION

1. Field of the Invention

Aspects of the present invention relate to an illumination apparatus including an organic light emitting device and a method of driving the illumination apparatus.

2. Description of the Related Art

Conventional illumination apparatuses, including organic light emitting devices, illuminate a white color via a red organic layer, a green organic layer, and a blue organic layer stacked in each pixel. In more detail, an identical data signal is applied to all of the pixels so that the red organic layer, the green organic layer, and the blue organic layer emit light at the same time, and thus an illumination white color is realized as red, green, and blue colors are additively mixed.

However, an operational voltage of the conventional illumination apparatus is increased due to the increased thickness of light emitting layers as a plurality of color organic layers are stacked. Also, since the organic layers are operated at the same time, it is difficult to adjust each of the organic light emitting devices and to display desired illumination colors.

SUMMARY OF THE INVENTION

Aspects of the present invention provide an illumination apparatus that displays desired illumination colors by individually adjusting light emission of red, blue, and green organic light emitting devices while reducing an operational voltage, and a method of driving the illumination apparatus.

According to an aspect of the present invention, there is provided an illumination apparatus comprising: a light emitting unit comprising a plurality of scanning lines, a plurality of data lines crossing the corresponding scanning lines, and a plurality of light emitting areas connected between the scanning lines and the data lines, wherein the light emitting areas include a first light emitting area including at least two first organic light emitting devices emitting a first color and a second light emitting area including at least two second light emitting devices emitting a second color different color from the first color; and a driving unit non-simultaneously driving the first light emitting area and the second light emitting area to emit light during a frame.

According to an aspect of the present invention, the driving unit may comprise: a scanning driving unit sequentially applying scanning signals to the scanning lines; and a data driving unit that applies a first data signal to at least one data line connected to the first light emitting area during a predetermined time period of the frame, and applies a second data signal to at least one data line connected to the second light emitting area during another time period of the frame.

According to an aspect of the present invention, the first color light emitted from the first light emitting area and the second color light emitted from the second light emitting area may be additively mixed to emit a third color light. The first light emitting area and the second light emitting area may not be emitted at the same time, but are respectively emitted during a frame, but the human eyes do not distinguish the individual emissions. That is, the human eyes may sense first color light emitted from the first light emitting area and second color light emitted from the second light emitting area during the one frame. Thus, although the light emitting areas may be driven individually according to the type of the organic light emitting device, the human eyes may sense relatively uniform color light. That is, the illumination apparatus may control light emission of each of the organic light emitting devices.

According to an aspect of the present invention, the driving unit may adjust at least one of the first data signal and the second data signal according to the light emitting efficiency of the first organic light emitting device or the second organic light emitting device. In detail, when the light emitting efficiency of the first organic light emitting device is larger than that of the second organic light emitting device, the first data signal may be reduced, and when the light emitting efficiency of the second organic light emitting device is larger than that of the first organic light emitting device, the second data signal may be reduced.

According to an aspect of the present invention, the driving unit may adjust either the predetermined time period during which the first light emitting area emits light or the other time period during which the second light emitting area emits light, or both time periods, according to the light emitting efficiency of the first and second organic light emitting devices. In detail, the driving unit may reduce a section of the predetermined time period among the frame as the light emitting efficiency of the first organic light emitting device is higher, or may reduce the other time period among the frame as the light emitting efficiency of the second organic light emitting device. That is, when the light emitting efficiencies of the first and second organic light emitting devices are different due to the materials, a desired illumination color may be emitted by adjusting the light emitting period of the light emitting area including each of the organic light emitting devices.

According to an aspect of the present invention, the light emitting unit may further comprise a third light emitting area which comprises at least two third organic light emitting devices that emit different color lights from the first and second organic light emitting devices, and the driving unit may operate the first, second, and third light emitting areas to emit light during a frame.

According to an aspect of the present invention, the first light emitting area may emit red color light, the second light emitting area may emit green color light, and the third light emitting area may emit blue color light.

According to an aspect of the present invention, the illumination apparatus may emit a white color light by additively mixing the red, green, and blue color lights.

According to an aspect of the present invention, there is provided a method of driving an illumination apparatus comprising a light emitting unit having a plurality of scanning lines, a plurality of data lines crossing the corresponding scanning lines, and a plurality of light emitting areas connected between the scanning lines and the data lines, wherein the light emitting areas include a first light emitting area including at least two first organic light emitting devices emitting a first color and a second light emitting area including at least two second light emitting devices emitting a second color different from the first color; and a driving unit non-simultaneously driving the first light emitting area and the second light emitting area to emit light during a frame, the method comprising: emitting light from the first light emitting area during a predetermined time period of a frame; and emitting light from the second light emitting area during an other time period of the frame.

According to an aspect of the present invention, the first light emitting area may emit the first color light, and the second light emitting area may emit the second color light, and the illumination apparatus may emit a third color light which is formed by additively mixing the first color light and the second color light.

According to an aspect of the present invention, identical data signals may be applied to the first organic light emitting devices during the predetermined time period of the frame via the data lines to emit light through the first light emitting area. Scanning signals may be sequentially applied to the first organic light emitting devices during the predetermined time period of the frame via the scanning lines to emit light through the first light emitting area.

According to an aspect of the present invention, identical data signals may be applied to the second organic light emitting devices during the other time period of the frame via the data lines to emit light through the second light emitting area. Scanning signals may be sequentially applied to the second organic light emitting devices during the other time period of the frame via the scanning lines to emit light through the second light emitting area.

According to an aspect of the present invention, there is provided a method of driving an illumination apparatus comprising a light emitting unit having a plurality of scanning lines, a plurality of data lines crossing the corresponding scanning lines, and a plurality of light emitting areas connected between the scanning lines and the data lines, wherein the light emitting areas include a first light emitting area including at least two first organic light emitting devices emitting a first color, a second light emitting area including at least two second light emitting devices emitting a second color, and a third light emitting area including at least two third organic light emitting devices emitting a third color, the method comprising: emitting the first color light from the first light emitting area during a predetermined time period of a frame; emitting the second color light from the second light emitting area during an other time period of the frame; and emitting the third color light from the third light emitting area during a further time period of the frame.

According to an aspect of the present invention, the first organic light emitting devices may emit red color light during the predetermined time period of the frame, and the second organic light emitting devices may emit green color light during the other time period of the frame, and the third organic light emitting devices may emit blue color light during the further time period of the frame, wherein the illumination apparatus emits an illumination white color light which is formed by additively mixing the red, green, and blue color lights emitted during the frame.

Additional aspects and/or advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENTS

Figure 1:
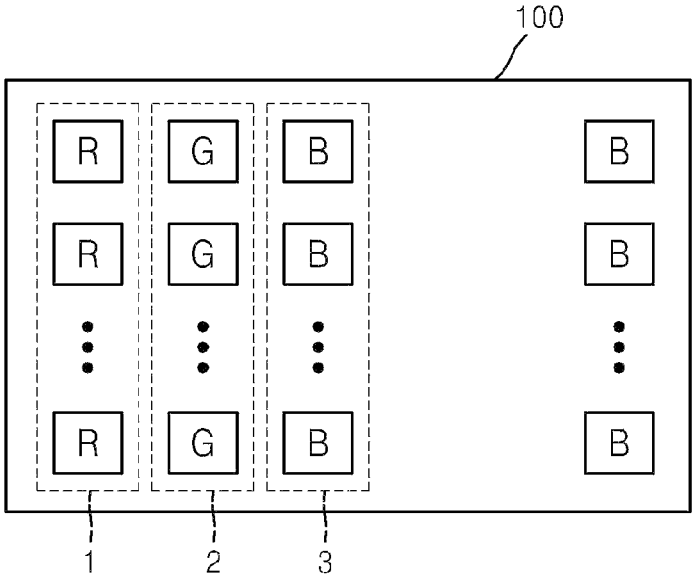
FIG. 1 is a schematic view illustrating a light emitting unit of an illumination apparatus including a plurality of organic light emitting devices, according to an embodiment of the present invention.

Reference will now be made in detail to the present embodiments of the present invention, examples of which are illustrated in the accompanying drawings, wherein like reference numerals refer to the like elements throughout. The embodiments are described below in order to explain aspects of the present invention by referring to the figures.

FIG. 1 is a schematic view illustrating a light emitting unit 100 of an illumination apparatus including a plurality of organic light emitting devices R, G and B, according to an embodiment of the present invention. Referring to FIG. 1, a light emitting surface of the light emitting unit 100 includes a first light emitting area 1 including a plurality of first organic light emitting devices R emitting red color light, a second light emitting area 2 including a plurality of second organic light emitting devices emitting G green color light, and a third light emitting area 3 including a plurality of third organic light emitting devices B emitting blue color light.

The first, second, and third light emitting areas 1, 2, and 3 are arranged in striped patterns on the light emitting surface. Identical types of organic light emitting devices R, G and B are arranged vertically on the light emitting surface, and different types of organic light emitting devices R, G and B are arranged horizontally on the light emitting surface. Aspects of the present invention provide an illumination apparatus including a plurality of organic light emitting devices, in which organic light emitting devices of the same type can be arranged in a group and operated at the same time, which is different from a conventional display apparatus that displays multiple colors. Accordingly, while shown as arranged vertically, the organic light emitting devices R, G and B may be arranged as a group along a vertical direction or in other directions.

Figure 2:
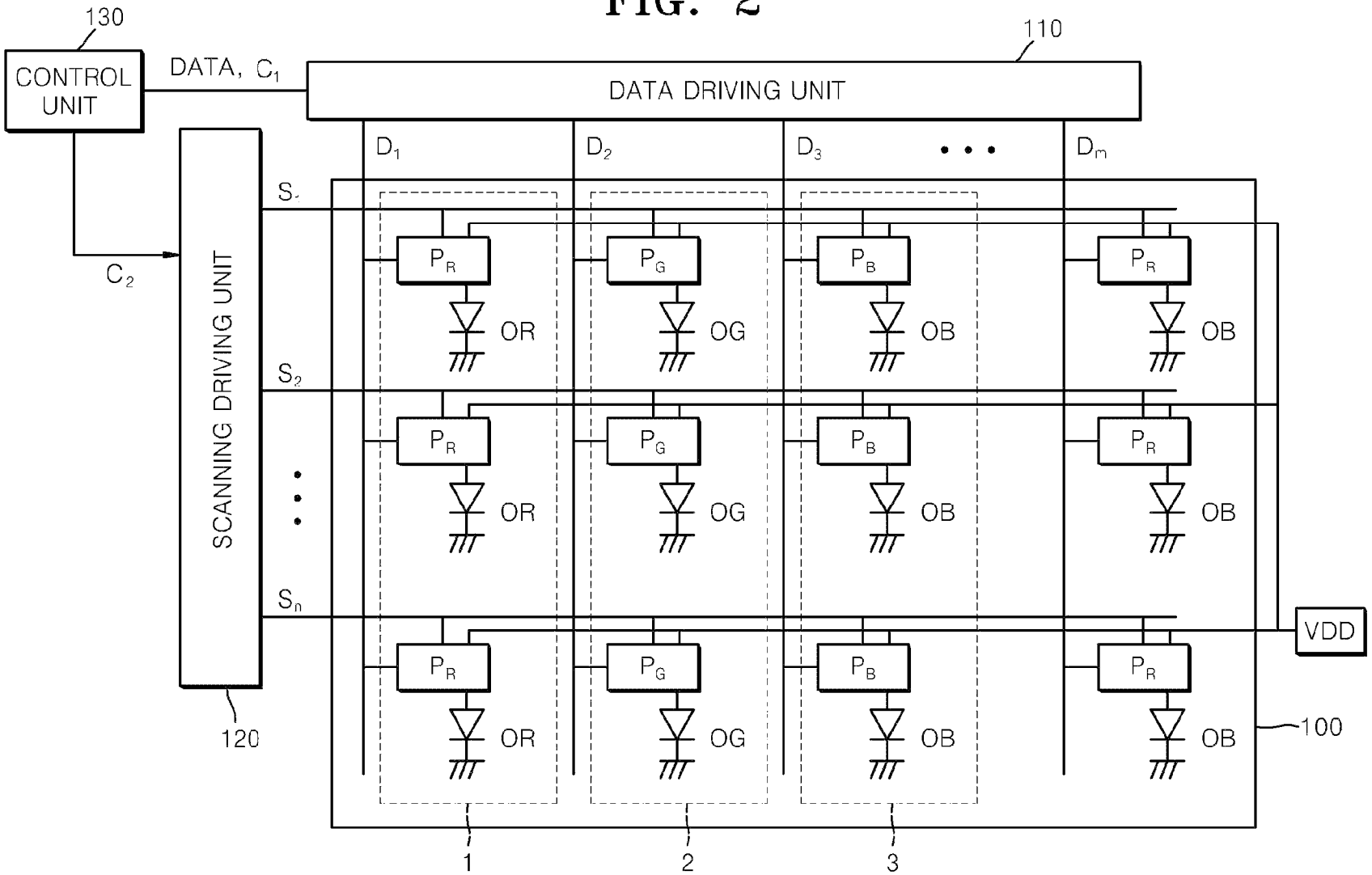
FIG. 2 is a block diagram for explaining an example of the illumination apparatus including the light emitting unit illustrated in FIG. 1.

The first, second, and third light emitting areas 1, 2, and 3, may be operated individually during a frame to display a predetermined color light. FIG. 2 is a block diagram for explaining the illumination apparatus including the light emitting unit 100 illustrated in FIG. 1. Referring to FIG. 2, the illumination apparatus includes the light emitting unit 100, a data driving unit 110, a scanning driving unit 120, and a control unit 130.

The light emitting unit 100 includes a plurality of data lines D1, D2, D3, . . . , Dm, a plurality of scanning lines S1, S2, S3, . . . , Sn crossing the data lines D1, D2, D3, . . . , Dm, and a plurality of pixels connected to the data lines D1, D2, D3, . . . , Dm and the scanning lines S1, S2, S3, . . . , Sn, respectively. Also, power source lines, for applying an operational voltage to the pixels, are included in the light emitting unit 100.

Each pixel includes an organic light emitting device and a pixel circuit $P_R$, $P_G$ and $P_B$ that transmits a data signal to the organic light emitting device. The light emitting unit 100 may have light emitting areas divided according to the type of organic light emitting devices disposed in the respective light emitting areas. According to the shown embodiment, three types of organic light emitting devices are included in the light emitting unit 100, and thus the light emitting unit 100 may be divided into the first light emitting area 1, the second light emitting area 2, and the third light emitting area 3. However, the invention need not be so limited.

The first light emitting area 1 includes a plurality of pixels, each pixel having a pixel circuit $P_R$ and a red organic light emitting device OR. The first light emitting area 1 is formed of a plurality of red organic light emitting devices OR and pixel circuits $P_R$ that are vertically arranged in one group. Also, the second light emitting area 2 includes a plurality of pixel circuits $P_G$ and a plurality of green organic light emitting devices OG, and the third light emitting area 3 includes a plurality of pixel circuits $P_B$ and a plurality of blue organic light emitting devices OB.

The pixel circuits $P_R$, $P_G$, and $P_B$ respectively include an operational transistor (not shown), at least one switching device (not shown), and at least one capacitor (not shown), and output a predetermined current through a drain terminal via a data signal applied to a gate terminal of the operational transistor and an operational voltage VDD applied to a source terminal. The current is transmitted to the organic light emitting devices OR, OG and OB, and accordingly, light is emitted from the organic light emitting devices, OR, OG and OB. The above-described pixel circuit $P_R$, $P_G$ and $P_B$ is just an example of a pixel circuit that is operated using a current driving method in an active matrix organic light emitting device (AMOLED), and a pixel circuit operated using a voltage driving method may also be used. Also, pixel circuits of a passive matrix organic light emitting device (PMOLED) may also be included. For convenience of the manufacturing process, it is preferable, but not required, that the pixel circuits $P_R$, $P_G$, and $P_B$ are of the same type.

The organic light emitting devices OR, OG and OB respectively include an electron injection layer (not shown), an electron transport layer (not shown), a light emitting layer (not shown), a hole transport layer (not shown), and a hole injection layer (not shown) between an anode and a cathode, and may display multiple colors according to the type of material of the light emitting layer.

The illumination apparatus according to the shown current embodiment of the present invention includes at least two different types of the organic light emitting devices emitting different color light and realizes illumination light by additively mixing the different light colors. According to the current embodiment, the illumination apparatus includes red, green, and blue organic light emitting devices. Thus, by additively mixing the light emitting colors, an illumination white color light can be emitted.

Also, the illumination apparatus includes the data driving unit 110 applying data signals to the data lines D1, D2, D3, . . . , Dm of the light emitting unit 100 and the scanning driving unit 120 applying scanning signals to the scanning lines S1, S2, S3, . . . , Sn of the light emitting unit 100.

The illumination apparatus includes the control unit 130 generating a data signal DATA corresponding to an input signal and predetermined control signals C1 and C2. Examples of the control signals C1 and C2 are vertical synchronization signals, horizontal synchronization signals, clock signals, etc. While not required, the control unit 130 can comprise a microprocessor or other processing devices encoded with software and/or firmware usable to control the illumination process.

Figure 3:
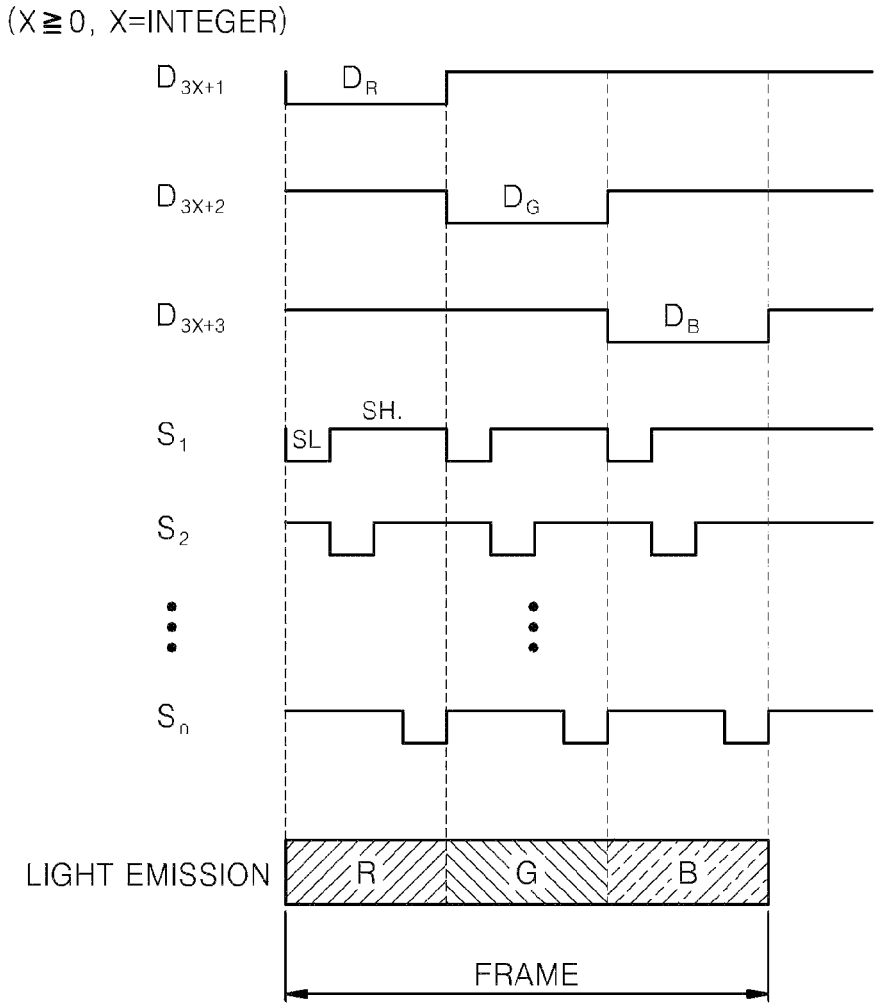
FIG. 3 is a timing diagram illustrating an example of signals applied to scanning lines and data lines so that the illumination apparatus illustrated in FIG. 2 emits light during a frame.

Hereinafter, a method of driving the illumination apparatus will be described with reference to FIG. 3. According to the current embodiment, the organic light emitting devices arranged in a vertical direction are divided in three light emitting areas. Thus, pixels connected to a (3X+1)th data line D3x+1 are included in the first light emitting area 1, pixels connected to a (3X+2)th data line D3x+2 are included in the second light emitting area 2, and pixels connected to a (3X+3)th data line D3x+3 are included in the third light emitting area 3. FIG. 3 is a timing diagram illustrating light emission of the illumination apparatus during one frame under the above-described condition.

Referring to FIG. 3, a first data signal DR is applied to the (3X+1)th data lines D3x+1 during a predetermined time period of the frame, a second data signal DG is applied to the (3X+2)th data lines D3x+2 during another time period of the frame, and a third data signal DB is applied to the (3X+3)th data lines D3x+3 during still another time period of the frame. Scanning signals SL and SH are sequentially applied to the scanning lines S1, S2, S3, . . . , Sn during each of the time periods of the frame. Accordingly, the first light emitting area 1 emits red color light during the predetermined time period of the frame, the second light emitting area 2 emits green color light during the another time period of the frame, and the third light emitting area 3 emits blue color light during the still another time period of the frame. Consequently, the illumination apparatus may emit light of white color for illumination, wherein the white color is obtained by additively mixing the red, green, and blue colors. The illumination white color light refers to not only a particular white color light that is emitted using the illumination apparatus according to aspects of the present invention but is meant to include a variety of white colors including the predetermined white color as lighting.

FIG. 3 illustrates a case in which driving transistors and switching devices included in the pixel circuits PR, PG, and PB of FIG. 2 are p-type metal oxide semiconductor field effect transistors (MOSFET).

Thus, the data signals applied to a gate terminal of the driving transistors have a low level. Also, the scanning signals applied to a gate terminal of the switching devices have a low level. When a low level scanning signal is applied to the gate terminal of the switching devices, the data signal is transmitted to the gate terminal of the driving transistors via the switching devices, and a current corresponding to the data signal may be output through a drain terminal. Accordingly, the organic light emitting devices may emit light in response to the received current.

The amplitude of the first data signal DR, the second data signal DG, and the third data signal DB or the interval of the time periods of the frame may be adjusted according to the light emitting efficiency of the organic light emitting devices. For example, if the light emitting efficiency of a green light emitting device is low, the amplitude of the second data signal DG transmitted to the green organic light emitting device may be increased or the corresponding time period of the frame may be extended. Thus, the light emission of each of the organic light emitting devices may be easily adjusted.

In addition, since each of the organic light emitting devices is disposed as one layer in each pixel, the thickness of the illumination apparatus according to aspects of the present invention is smaller than that of conventional illumination apparatuses, and thus an increase in the operational voltage can be prevented.

According to the illumination apparatus and the method of driving the same of aspects of the present invention, at least two types of organic light emitting devices are not stacked but are individually arranged in light emitting areas, and thus can be driven by applying data signals via different data lines. Accordingly, desired light colors can be displayed in consideration of light emitting efficiency of the organic light emitting devices. Also, since the two types of organic light emitting devices are not stacked, an increase in the operational voltage due to the stacking thickness can be prevented.

Although a few embodiments of the present invention have been shown and described, it would be appreciated by those skilled in the art that changes may be made in this embodiment without departing from the principles and spirit of aspects of the invention, the scope of which is defined in the claims and their equivalents.

What is claimed is:

1. An illumination apparatus comprising:

a light emitting unit comprising a plurality of scanning lines, a plurality of data lines crossing corresponding ones of the scanning lines, and a plurality of light emitting areas connected between the scanning lines and the data lines, wherein the light emitting areas include a first light emitting area including at least two first organic light emitting devices emitting a first color light and a second light emitting area including at least two second organic light emitting devices emitting a second color light different from the first color light;

and a driving unit non-simultaneously driving the first light emitting area and the second light emitting area to emit light during a frame, wherein emissions of the first color light and the emissions of the second color light are non-simultaneous, and wherein all of the first organic light emitting devices that are coupled to a same one of the data lines receive a first data signal having a same level during the frame to emit the first color light, and all of the second organic light emitting devices that are coupled to a same one of the data lines receive a second data signal having a same level during the frame to emit the second color light.

2. The illumination apparatus of claim 1, wherein the driving unit comprises:

a scanning driving unit sequentially applying scanning signals to the scanning lines; and a data driving unit that applies the first data signal to at least one data line connected to the first light emitting area during a predetermined time period of the frame, and applies the second data signal to at least one data line connected to the second light emitting area during another time period of the frame.

3. The illumination apparatus of claim 2, wherein the first color light emitted from the first light emitting area and the second color light emitted from the second light emitting area are additively mixed to emit a third color light.

4. The illumination apparatus of claim 2, wherein the driving unit adjusts at least one of the first data signal and the second data signal according to the light emitting efficiency of the first organic light emitting devices or the second organic light emitting devices.

5. The illumination apparatus of claim 4, wherein the driving unit adjusts the predetermined time period during which the first light emitting area emits light or the another time period during which the second light emitting area emits light, according to the light emitting efficiency of the first and second organic light emitting devices.

6. The illumination apparatus of claim 1, wherein the light emitting unit further comprises a third light emitting area which comprises at least two third organic light emitting devices that emit a third color light that is different from the first and second color lights, and wherein the driving unit drives the first, second, and third light emitting areas to emit light during the frame.

7. The illumination apparatus of claim 6, wherein the first light emitting area emits red color light, the second light emitting area emits green color light, and the third light emitting area emits blue color light.

8. The illumination apparatus of claim 7, wherein the illumination apparatus emits that which is perceived as a white color light by additively mixing the red, green, and blue color lights.

9. A method of driving an illumination apparatus comprising a light emitting unit having a plurality of scanning lines, a plurality of data lines crossing corresponding ones of the scanning lines, and a plurality of light emitting areas connected between the scanning lines and the data lines, wherein the light emitting areas include a first light emitting area including at least two first organic light emitting devices emitting a first color light and a second light emitting area including at least two second organic light emitting devices emitting a second color light different from the first color light; and a driving unit non-simultaneously driving the first light emitting area and the second light emitting area to emit light during a frame, the method comprising:

emitting the first color light from the first light emitting area during a predetermined time period of the frame by delivering a first data signal having a same level to all of the first light emitting devices that are coupled to a same one of the data lines; and emitting the second color light from the second light emitting area during another time period of the frame by delivering a second data signal having a same level to all of the second light emitting devices coupled to a same one of the data lines, wherein emissions of the first color light and the emissions of the second color light are non-simultaneous.

10. The method of claim 9, wherein the first light emitting area emits the first color light, and the second light emitting area emits the second color light, and the illumination apparatus emits a third color light which is formed by additively mixing the first color light and the second color light.

11. The method of claim 9, wherein identical data signals are applied to the first organic light emitting devices during the predetermined time period of the frame via the data lines to emit light through the first light emitting area.

12. The method of claim 11, wherein scanning signals are sequentially applied to the first organic light emitting devices during the predetermined time period of the frame via the scanning lines to emit light through the first light emitting area.

13. The method of claim 9, wherein identical data signals are applied to the second organic light emitting devices during the another time period of the frame via the data lines to emit light through the second light emitting area.

14. The method of claim 13, wherein scanning signals are sequentially applied to the second organic light emitting devices during the another time period of the frame via the scanning lines to emit light through the second light emitting area.

15. A method of driving an illumination apparatus comprising a light emitting unit having a plurality of scanning lines, a plurality of data lines crossing corresponding ones of the scanning lines, and a plurality of light emitting areas connected between the scanning lines and the data lines, wherein the light emitting areas include a first light emitting area including at least two first organic light emitting devices emitting a first color light, a second light emitting area including at least two second organic light emitting devices emitting a second color light, and a third light emitting area including at least two third organic light emitting devices emitting a third color light, the method comprising:

sending a first signal having a same level to all of the first light emitting devices that are coupled to a same one of the data lines to emit the first color light from the first light emitting area during a predetermined time period among a frame;

sending a second signal having a same level to all of the second light emitting devices that are coupled to a same one of the data lines to emit the second color light from the second light emitting area during another time period among the frame; and emitting the third color light from the third light emitting area during a further time period among the frame, wherein emissions of the first color light and the emissions of the second color light are non-simultaneous.

16. The method of claim 15, wherein the first organic light emitting devices emit red color light during the predetermined time period of the frame, and the second organic light emitting devices emit green color light during the another time period of the frame, and the third organic light emitting devices emit blue color light during the further time period of the frame, wherein the illumination apparatus emits that which is perceived as a white color light, which is formed by additively mixing the red, green, and blue color lights emitted during the frame.

17. A display apparatus having organic light emitting devices, the display apparatus comprising:

a light emitting unit having scanning lines, data lines, and light emitting areas at corresponding crossing points of the scanning lines and the data lines, wherein the light emitting areas are disposed in one layer and include a first light emitting area including at least two first organic light emitting devices for receiving a first signal having a same level during a frame via a first corresponding one of the data lines to emit a first color light and a second light emitting area including at least two second light emitting devices for receiving a second signal having a same level during the frame via a second corresponding one of the data lines to emit a second color light different from the first color light; and a driving unit driving the first light emitting area and the second light emitting area to emit light during the frame, wherein emissions of the first color light and the emissions of the second color light are non-simultaneous.

18. The display apparatus of claim 17, wherein the organic light emitting devices are not stacked.

19. The display apparatus of claim 17, wherein an operational voltage of the light emitting unit drives only the one layer of the organic light emitting devices.

20. The display apparatus of claim 17, wherein the first and second light emitting areas disposed in the one layer are arranged in a striped pattern.

21. The display apparatus of claim 17, wherein a plurality of same type light emitting devices are disposed sequentially in a first linear direction.

22. The display apparatus of claim 21, wherein a plurality of different type light emitting devices are disposed sequentially in a second linear direction different than the first linear direction.

23. The display apparatus of claim 22, wherein the first linear direction is perpendicular to the second linear direction.

24. The display apparatus of claim 21, wherein the plurality of the same type light emitting devices are operated at the same time to display a predetermined color during the frame.

25. A method of displaying a frame on a display apparatus, the method comprising:

driving a first data signal having a same level from a start of the frame for a first time period of the frame to display a first color light emitted by a plurality of first organic light emitting devices that are coupled to a first common data line during the first time period of the frame; and driving a second data signal having a same level for a second time period of the frame other than the first time period of the frame to display a second color light emitted by a plurality of second organic light emitting devices that are coupled to a second common data line during the second time period of the frame, wherein an illuminated color is displayed when the first and second color lights are additively mixed, and wherein emissions of the first color light and the emissions of the second color light are non-simultaneous.

26. The method of claim 25, wherein the driving the first and second data signals to display the first and second color lights comprise:

scanning a plurality of scanning lines;

transmitting the first and second data signals on a plurality of data lines crossing the scanning lines; and illuminating a plurality of light emitting areas connected between the scanning lines and the data lines, wherein the first color light is illuminated in a first one of the light emitting areas having a first light emitting area including at least two first organic light emitting devices, and wherein the second color light is illuminated in a second one of the light emitting areas having a second light emitting area having at least two second light emitting devices.

* * * * *